US007644844B1

(12) United States Patent
Bonner

(10) Patent No.: US 7,644,844 B1
(45) Date of Patent: Jan. 12, 2010

(54) CLOTHES HANGER

(76) Inventor: James D. Bonner, 2605 Wright Rd., Akron, OH (US) 44320

( * ) Notice: Subject to any disclaimer, the term of this patent is extended or adjusted under 35 U.S.C. 154(b) by 0 days.

(21) Appl. No.: 11/450,176

(22) Filed: Jun. 12, 2006

(51) Int. Cl.
*A41D 27/22* (2006.01)

(52) U.S. Cl. ..... 223/94; 223/85

(58) Field of Classification Search ..... 223/85–98
See application file for complete search history.

(56) References Cited

U.S. PATENT DOCUMENTS

| | | | | |
|---|---|---|---|---|
| 923,786 | A | 6/1909 | Geraci | |
| 2,491,836 | A | 12/1949 | Sinnet | |
| 3,024,954 | A * | 3/1962 | Michlin | 223/95 |
| 3,632,028 | A * | 1/1972 | Fussel | 223/95 |
| 3,645,426 | A * | 2/1972 | Glascock et al. | 223/89 |
| 5,044,535 | A * | 9/1991 | Hunt | 223/95 |
| 5,052,599 | A | 10/1991 | Platti | |
| 5,085,358 | A | 2/1992 | Lam | |
| 5,476,199 | A | 12/1995 | Halverson et al. | |
| 5,480,075 | A | 1/1996 | Robinson | |
| 5,711,464 | A | 1/1998 | Huang | |
| 6,003,743 | A | 12/1999 | Deady | |
| 6,021,932 | A * | 2/2000 | Lam | 223/94 |
| 6,164,504 | A | 12/2000 | Richard | |
| 6,179,174 | B1 | 1/2001 | Kandl | |
| 6,206,255 | B1 | 3/2001 | Turner | |
| 6,213,672 | B1 | 4/2001 | Varga | |
| 6,220,489 | B1 | 4/2001 | Sato | |
| 6,722,538 | B1 | 4/2004 | Autry et al. | |
| 6,964,360 | B2 | 11/2005 | Tubman et al. | |
| 2005/0035159 | A1 * | 2/2005 | Hunt et al. | 223/94 |

* cited by examiner

*Primary Examiner*—Gary L Welch
*Assistant Examiner*—Andrew W Sutton
(74) *Attorney, Agent, or Firm*—John D. Gugliotta, PE, Esq.

(57) ABSTRACT

A clothes hanger is provided having a first fixed arm and a second retractable arm to allow for easy placement of clothing thereon. The instant abstract is neither intended to define the invention disclosed in this specification nor intended to limit the scope of the invention in any way.

5 Claims, 3 Drawing Sheets

CLOTHES HANGER

BACKGROUND OF THE INVENTION

1. Field of the Invention

This invention relates to a clothes hanger and, more specifically, to a clothes hanger having a retractable arm to allow for easy placement of clothing thereon.

2. Description of the Related Art

Various types and styles of clothing are generally available, and such styles tend to ebb and flow in cycles depending upon fashion trends, seasons, personal taste, specific need or function, and other ephemeral and unspoken reasons. With the exception of various sized, however, most clothing in the united states are hung in closets using a simple, one-piece rigid hanger mechanism having a hook connected to laterally opposed arm extension. While adequate for most applications, such a fixed body can be inconvenient to use with those types and styles of clothing that do not have a split front. By way of example, the hanging of a turtleneck sweater can be difficult, sometimes impossible to accomplish without disheveling of the garment.

Several broad categories of improved hangers exist. Generally, they can be categorized as angularly extendable, telescopingly adjustable, or specialized function.

For example, the first group, angularly extendible, attempts to change the overall width of the hanger by adjusting the angle between opposing arm members. This is typified by U.S. Pat. No. 6,964,360, issued in the name of Tubman et al., wherein an adjustable clothes hanger that includes a pair of pivoting arm members that lockably engage at differing pivot points to allow each opposing arm member to be fixed in various positions along a lateral track. Similarly, U.S. Pat. No. 5,711,464, issued in the name of Huang provides for making the hanger wider or narrower in overall width by repositioning a single flexible arm member at differing angles. Also, U.S. Pat. No. 923,786, issued in the name of Geraci, provides for a scissor-like pivot between opposing arm members.

The second group, telescopingly adjustable, does not change the angle between arm members, but rather attempts to telescope or otherwise extend these arm members away from each other in an attempt to affect overall size of the hanger. This can be illustrated by U.S. Pat. No. 6,179,174, issued in the name of Kandl; U.S. Pat. No. 5,085,358, issued in the name of Lam; U.S. Pat. No. 6,722,538, issued in the name of Autry et al; and U.S. Pat. No. 2,491,836, issued in the name of Simmet.

A subset of such telescopingly adjustable hangers provides for various extension gadgets that work in conjunction with fixed arm hangers. Examples of such appear in U.S. Pat. No. 5,052,599, issued in the name of Platti, in which the hanger hook portion is vertically adjustable, and U.S. Pat. No. 6,164,504, issued in the name of Richard, in which a separable hanger extension is provided that can be clipped onto an otherwise conventional hanger.

Finally, special function hangers exist in which an unconventional form is provided, specifically adapted for the task. Examples appear in:

U.S. Pat. No. 6,206,255, issued in the name of Turner;

U.S. Pat. No. 6,220,489, issued in the name of Sato;

U.S. Pat. No. 5,480,075, issued in the name of Robinson; and

U.S. Pat. No. 6,003,743, issued in the name of Deady.

However, none of these solutions are adapted to or adequately address the need of placement of the hanger into clothing that does not have a split or opening within the body or expansion in the neck opening. Consequently, a need has been felt for providing an apparatus and method of providing a clothes hanger having a retractable arm to allow for easy placement of clothing thereon.

SUMMARY OF THE INVENTION

It is therefore an object of the present invention to provide an improved clothing hanger.

It is a feature of the present invention to provide an improved clothes hanger having a retractable arm to allow for easy placement of clothing thereon.

Briefly described according to one embodiment of the present invention, a clothes hanger is provided having an upper body member having a first lateral side opposite a second lateral side. An upper hood is affixed to the body member, and the first lateral side forms a receiving channel. A first extension arm member is fixed rigidly to the second lateral side, and a second extension arm member is retained within the receiving channel. The second extension arm member slidably extends or retracts within the receiving channel to aid in the insertion or withdrawal of the hanger from the neck opening of a garment.

In accordance with a preferred embodiment, the hanger can be retracted for easy insertion into a sweater or other garment through the neck opening, with the ability to thereafter extend and function just like any otherwise conventional hanger.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures

1. Detailed Description of the Figures

Figure 1:
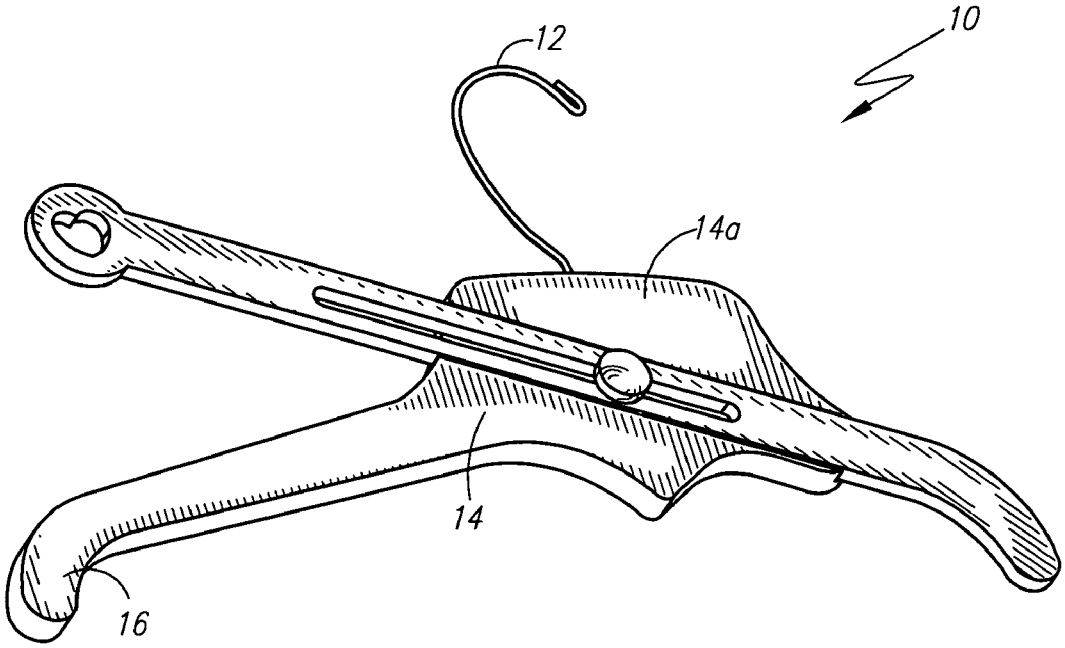
FIG. 1 is a perspective view of an improved clothes hanger according to the preferred embodiment of the present invention.
Figure 2:
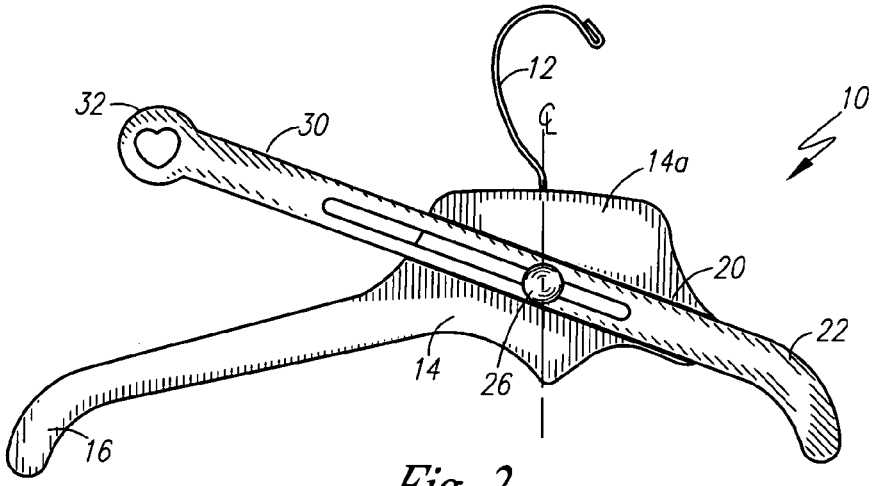
FIG. 2 is a front elevational view thereof, shown in a retracted state.
Figure 3:
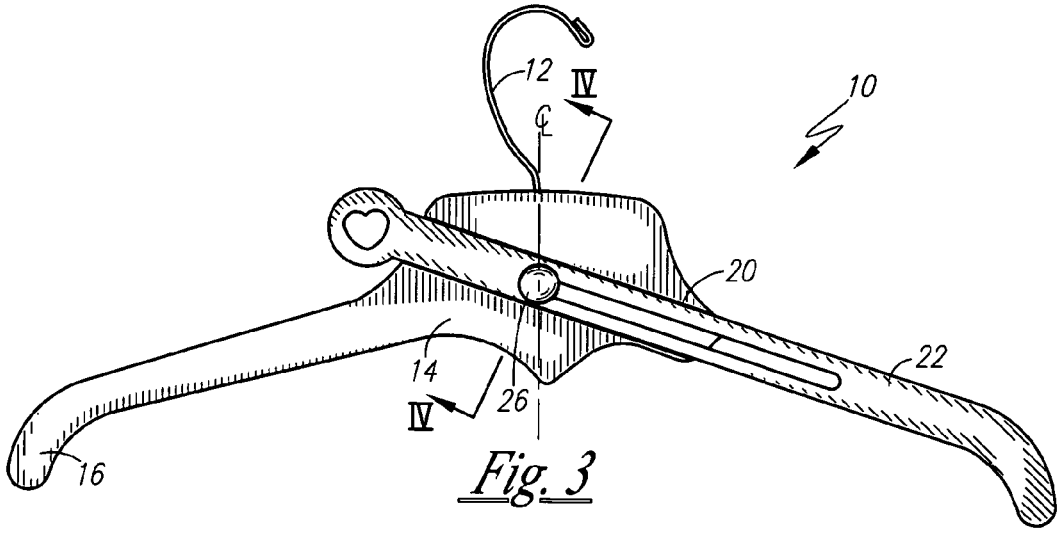
FIG. 3 is a front elevational view thereof, shown in an extended state.
Figure 4:
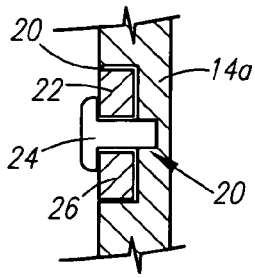
FIG. 4 is a cross sectional view taken along line IV-IV of FIG. 3.

Referring to FIGS. 1-3, an improved clothes hanger, generally noted as 10, is shown in accordance with the preferred embodiment of the present invention having a vertical support hook 12 extending from a hanger body 14. The size, style or nature of the support hook 12 is not considered to be a key element of the present invention, and so the support hook 12 is intended to be shown as an exemplary element only. The hanger body 14 can take many shapes; for purposes of disclosing the preferred embodiment, a upper body element **14*a* extends laterally in a first direction to a generally linearly elongated first fixed lateral extension arm 16. It is anticipated that this first arm 10 would appear in form or function similar to one half of a conventional clothes hanger. However, in a departure the upper body element 14***a* forms a receiving channel 20 angularly positioned in a manner symmetric to the first arm 16 about a vertical centerline "CL". The receiving channel 20 supports a slidably engaged second moveable lateral extension arm 22 in a manner better described in conjunction with FIG. 4. As shown in FIG. 4, the second arm 22 is formed of a linearly elongated member that forms a central channel 24 the therein. The elongated member 22 slides fittingly within the receiving channel 20. The central channel 24 circumscribes an attachment pin 26, herein shown as being located at the centerline "CL". The attachment pin 26 holds the second arm 22 within the channel 20, and allows the second arm 22 to slide inward and outwards along the length of the central channel 24.

Additionally, the inside end 30 of the second arm 22 can terminate at a grasping point 32 that will allow for easy manual manipulation of the second arm 22 about the slot 20.

2. Operation of the Preferred Embodiment

Figure 5:
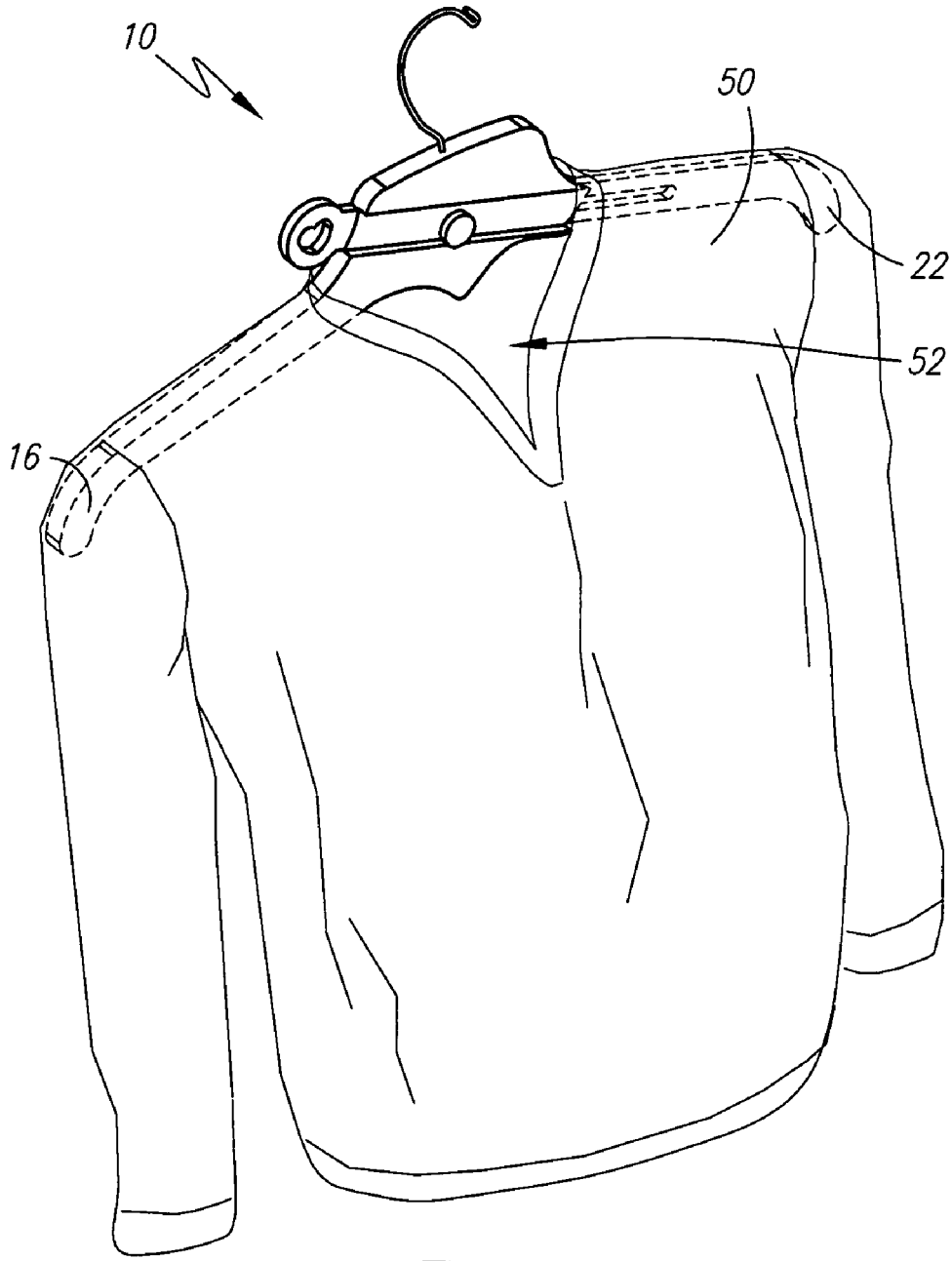
FIG. 5 is a perspective view thereof shown being used to support an article of clothing.

As shown in conjunction with FIG. 5, in operation the present invention is used in conjunction with a garment 50, the clothes hanger 10 has one fixed arm 16 and a retractable arm 22 to allow for easy placement the hanger 10 within a head or neck hole 52 of the garment 50. By retracting the second arm 22, the first arm 16 can be easily inserted into the neck hole 52 such that the body 14*a* is positioned in the proper, normal position without pulling, stretching, or otherwise dislocating the cloth of the garment 50. Once in position, the second arm 22 is extended outward, thereby providing the function of an otherwise conventional hanger.

To remove the hanger 10, the second arm 22 can be retracted, similarly allowing the body 14*a* to be removed clothes hanger having a retractable arm to allow for easy placement of clothing thereon, without stretching of the garment 50.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A clothes hanger comprising:

an upper body member having a first lateral side opposite a second lateral side, wherein said first lateral side forms a receiving channel therethrough;

an upper hook affixed to said upper body member;

a first extension arm member fixed rigidly to said second lateral side;

a retaining pin fixed to said upper body member within said receiving channel;

a second extension arm member retained within said receiving channel and secured by said retaining pin; wherein said second extension arm member slidably extends or retracts within said receiving channel in a direction symmetric to said first extension arm member about a vertical centerline of said upper body member; and a channel formed within said second extension arm member; wherein said retaining pin extends through said channel, thereby slidably securing said second extension arm member to said upper body member.

2. A clothes hanger comprising:

a hanger body;

a vertical support hook extending from said hanger body;

an upper body element extending laterally in a first direction to a generally linearly elongated first fixed lateral extension arm;

a receiving channel formed within said upper body element; and a second moveable lateral extension arm slidably engaged in said receiving channel;

wherein said second movable lateral extension arm member slidably extends or retracts within said receiving channel in a direction symmetric to said first fixed lateral extension arm about a vertical centerline of said hanger body;

wherein said second arm is formed of a linearly elongated member that forms a central channel therein.

3. The clothes hanger of claim 2, further comprising an attachment pin located at said centerline, wherein said central channel circumscribes said attachment pin such that said attachment pin retains said second arm within said channel, thereby allowing said second arm to slide inward and outwards along the length of said central channel.

4. The clothes hanger of claim 1, further comprising a grasping member at an inside distal end of said second arm, said grasping member provides a means to manipulate an extension of and a retraction of said second arm.

5. The clothes hanger of claim 2, further comprising a grasping member at an inside distal end of said second arm, said grasping member provides a means to manipulate an extension of and a retraction of said second arm.

* * * * *

UNITED STATES PATENT AND TRADEMARK OFFICE

CERTIFICATE OF CORRECTION

PATENT NO. : 7,644,844 B1
APPLICATION NO. : 11/450176
DATED : January 12, 2010
INVENTOR(S) : James D. Bonner It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 189 days.

Signed and Sealed this

Sixteenth Day of November, 2010

David J. Kappos

David J. Kappos
*Director of the United States Patent and Trademark Office*